US007469683B2

(12) United States Patent
Mason et al.

(10) Patent No.: US 7,469,683 B2
(45) Date of Patent: Dec. 30, 2008

(54) FUEL SYSTEM WITH PRESSURE REGULATION AND PRESSURE RELIEF

(75) Inventors: Paul Mason, Dearborn, MI (US); Werner Schneider, Bloomfield Hills, MI (US); John Lennen, Wixom, MI (US); Martin Kling, Beverly Hills, MI (US); Martin Ptacek, Ceske Budejovice (CZ); David Liskovec, Hluboka Nad Vltavou (CZ); Martin Sykora, Ceske Budejovice (CZ); Thomas Wieland, Stuttgart (DE); Erik Hahmann, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/693,507

(22) Filed: Mar. 29, 2007

(65) Prior Publication Data

US 2007/0227510 A1 Oct. 4, 2007

Related U.S. Application Data

(60) Provisional application No. 60/743,890, filed on Mar. 29, 2006.

(51) Int. Cl.
*F02M 37/04* (2006.01)
*F04B 23/04* (2006.01)
*F04B 23/14* (2006.01)

(52) U.S. Cl. ..... 123/509; 123/514; 417/77; 417/87

(58) Field of Classification Search ..... 123/457, 123/458, 509, 510, 511, 514; 417/76, 77, 417/79, 80, 87

See application file for complete search history.

(56) References Cited

U.S. PATENT DOCUMENTS 4,926,829 A * 5/1990 Tuckey ..... 123/497
5,133,324 A * 7/1992 Michiaki ..... 123/514
5,289,810 A * 3/1994 Bauer et al. ..... 123/510

(Continued)

FOREIGN PATENT DOCUMENTS

EP 1126157 8/2001

(Continued)

OTHER PUBLICATIONS

PCT/US2007/065517 International Search Report dated Nov. 19, 2007.

*Primary Examiner*—Thomas N Moulis
(74) *Attorney, Agent, or Firm*—Michael Best & Friedrich LLP

(57) ABSTRACT

A fuel supply system is provided for delivering fuel from a tank to an engine of a motor vehicle through a fuel line. The system is provided with a pressure relief valve to divert fuel from the fuel line during engine shut down conditions when fuel flow to the engine is not desired. The pressure relief valve has a fuel outlet that is provided with backpressure during engine operation. The backpressure enables the pressure relief valve to be set at a lower level because the backpressure is added to set point pressure to determine opening of the pressure relief valve. Lowering the set point of the pressure relief valve allows fuel to be diverted from the engine at a lower fuel line pressure. In one embodiment backpressure is provided by fluid communication from a jet pump supplying fuel from the fuel tank to a fuel system reservoir.

24 Claims, 5 Drawing Sheets

U.S. PATENT DOCUMENTS

| | | | | |
|---|---|---|---|---|
| 5,477,829 | A | 12/1995 | Hassinger et al. | |
| 5,692,479 | A | 12/1997 | Ford et al. | |
| 5,715,798 | A | 2/1998 | Bacon et al. | |
| 5,732,684 | A | 3/1998 | Thompson | |
| 5,791,317 | A * | 8/1998 | Eck | 123/510 |
| 5,887,572 | A | 3/1999 | Channing | |
| 6,341,623 | B1 | 1/2002 | Channing | |
| 6,343,589 | B1 * | 2/2002 | Talaski et al. | 123/514 |
| 6,425,378 | B1 * | 7/2002 | Frank | 123/514 |
| 6,457,459 | B1 * | 10/2002 | Schelhas et al. | 123/514 |
| 6,474,310 | B2 * | 11/2002 | Joos et al. | 123/497 |
| 6,505,644 | B2 | 1/2003 | Coha et al. | |
| 6,532,941 | B2 | 3/2003 | Begley et al. | |
| 6,622,707 | B2 | 9/2003 | Begley et al. | |
| 6,792,918 | B1 | 9/2004 | Halsall | |
| 6,907,899 | B2 | 6/2005 | Yu et al. | |
| 6,966,306 | B2 | 11/2005 | Sawert et al. | |
| 7,077,109 | B2 * | 7/2006 | Lee | 123/514 |
| 7,275,524 | B2 * | 10/2007 | Schelhas et al. | 123/514 |
| 7,303,378 | B2 * | 12/2007 | Kleppner et al. | 417/87 |
| 7,353,807 | B2 * | 4/2008 | Paluszewski | 123/509 |
| 2001/0018908 | A1 | 9/2001 | Joos et al. | |
| 2001/0029760 | A1 | 10/2001 | Kleppner et al. | |
| 2002/0043253 | A1 | 4/2002 | Begley et al. | |
| 2003/0062031 | A1 | 4/2003 | Tanimura | |
| 2004/0219029 | A1 | 11/2004 | Kleppner et al. | |
| 2005/0045159 | A1 | 3/2005 | Honda et al. | |
| 2005/0178367 | A1 | 8/2005 | Wolters et al. | |

FOREIGN PATENT DOCUMENTS

| | | |
|---|---|---|
| EP | 1300582 | 4/2003 |
| EP | 1566536 | 8/2005 |
| WO | 2005108146 | 11/2005 |

* cited by examiner

FUEL SYSTEM WITH PRESSURE REGULATION AND PRESSURE RELIEF

RELATED APPLICATIONS

This application claims the priority of U.S. Provisional Application No. 60/743,890 filed on Mar. 29, 2006.

BACKGROUND

The invention relates to fuel systems with pressure regulation.

In a returnless fuel supply system for a fuel injected engine, a certain fuel pressure must be maintained at the fuel rail during engine operation and after the engine is turned off. This pressure regulation can be done mechanically or electronically when the engine is on and mechanically when the engine is off. When the pressure regulation is electronic, the pump voltage is varied to maintain the set pressure. It is desirable to provide pressure relief for hot soak conditions, which frequently occur, for example, when the engine is turned off after operating long enough to open the coolant thermostat.

SUMMARY

In one embodiment, the invention provides a fuel supply system in which the outlet of the pressure relief valve is provided with backpressure when the engine is operating and is provided with significantly less backpressure when the engine is not operating. This allows the pressure relief valve to have a lower set pressure, because during normal engine operation the pressure relief valve does not open until the pressure in the fuel rail equals the sum of the set pressure plus the backpressure. When the engine is not operating, significantly less pressure is required to open the pressure relief valve, because the backpressure at the pressure relief valve is significantly less. Because less pressure is required to open the pressure relief valve, the mechanical load on the fuel system during hot soaks is significantly reduced. This reduces the cost and complexity of the system.

In another embodiment, the invention provides a fuel supply system in which the outlet of the pressure relief valve is connected to the jet pump supply side.

Other aspects of the invention will become apparent from the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
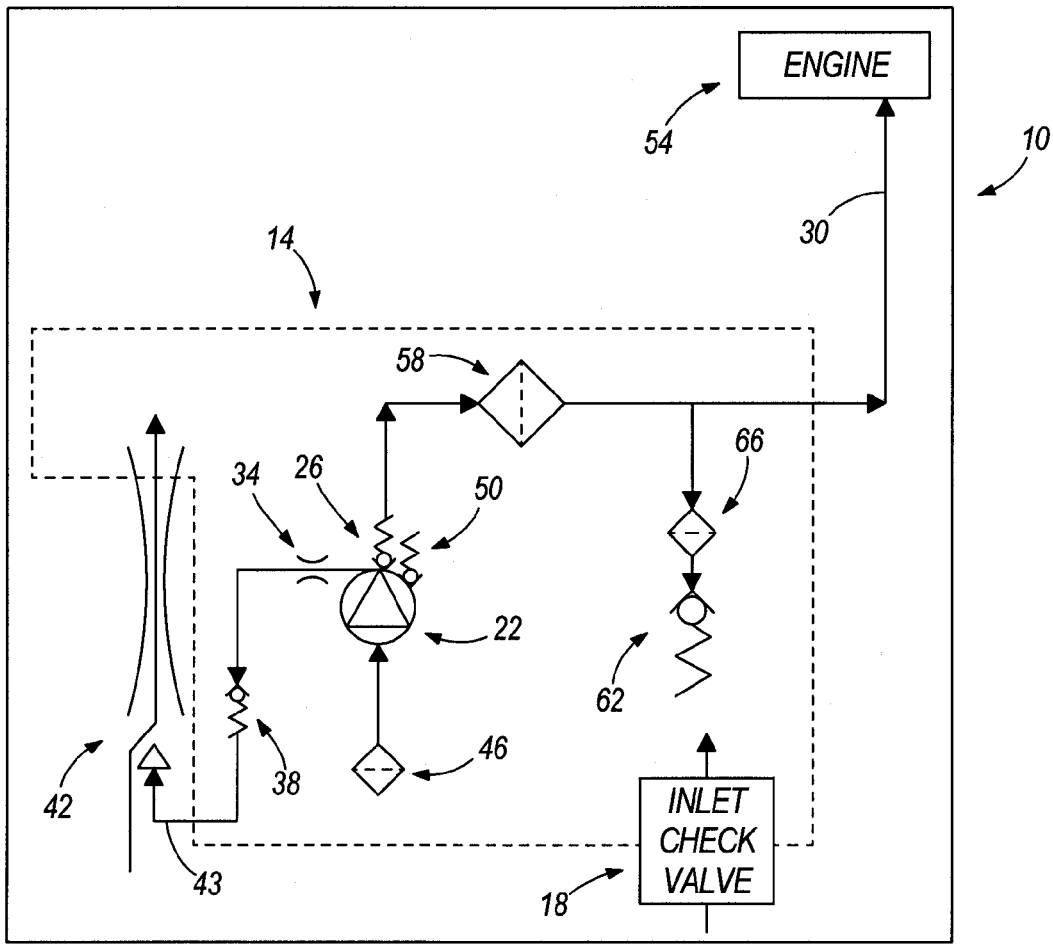
FIG. 1 is a schematic diagram of a fuel supply system in which the outlet of the pressure relief valve communicates with the fuel reservoir.

FIG. 1 illustrates a returnless fuel supply system 10 including a fuel reservoir 14 indicated by broken lines. The fuel reservoir 14 communicates with a larger fuel tank (not shown) via an inlet check valve 18. Inside the fuel reservoir 14 is a fuel pump 22 having an outlet communicating via a check valve 26 with the inlet of a fuel line 30. The check valve 26 opens at a relatively low pressure of, for example, 20 kPa. The fuel pump 22 has a second outlet that is a throttled orifice 34 communicating through a check valve 38 with a jet pump 42. The jet pump 42, as is known in the art, draws fuel from the fuel tank into the fuel reservoir 14. The fuel pump 22 also has an intake communicating with the fuel reservoir 14 via a fuel filter 46. The fuel pump 22 also has a fuel pump pressure relief valve 50. The fuel pump pressure relief valve 50 opens at a relatively high pressure of, for example, 650 kPa.

The outlet of the fuel line 30 communicates with a fuel rail (not shown) connected to the fuel injectors (not shown) of an engine 54. The fuel line 30 includes a fuel filter 58. The fuel supply system 10 is typically electronically regulated, and as such the pump voltage is constantly varied by an electronic control (not shown) in order to maintain a set pressure in the fuel rail. A pressure relief valve 62 has an inlet communicating with the fuel line 30 between the fuel filter 58 and the engine 54. A smaller fuel filter 66 is located upstream of the pressure relief valve 62. The outlet of the pressure relief valve 62 communicates with the fuel reservoir 14, which is nominally at atmospheric pressure. The set pressure of the pressure relief valve 62 must be high enough that the pressure relief valve 62 does not open during normal engine operation, including during high pressure starting. Thus, the pressure relief valve 62 may be set to open, for example, at a pressure of 520 kPa. At this set pressure, the pressure relief valve 62 will only open during abnormal engine operation or during engine hot soaks, such as when the engine 54 is turned off.

The relatively high set pressure of the pressure relief valve 62 increases the mechanical load on the fuel system 10 during hot soaks, as the pressure in the fuel line 30 can reach 520 kPa before the pressure relief valve 62 opens. This mechanical load requires a more robust system design, from the fuel pump 22 to the fuel rail, increasing cost and complexity throughout the system.

Figure 2:
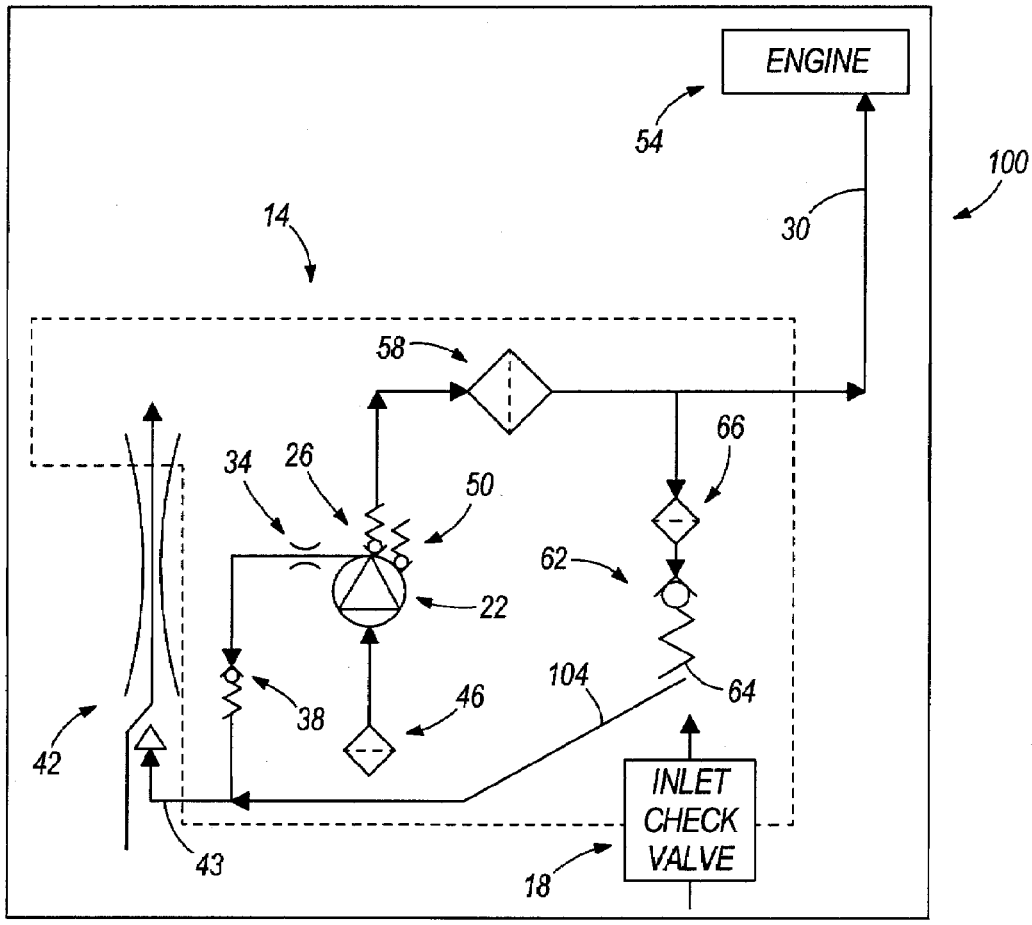
FIG. 2 is a schematic diagram of a fuel supply system in which the outlet of the pressure relief valve communicates with the supply side of the jet pump.

FIG. 2 illustrates another returnless fuel supply system 100. Except as described below, the system 100 is substantially identical to the system 10 of FIG. 1, and common elements have been given the same reference numerals.

The system 100 differs from the system 10 in that the outlet of the pressure relief valve 62 communicates with the pressurized supply side of the jet pump 42 rather than with the interior of the fuel reservoir 14. This is indicated by pressure relief line 104. When the engine 54 is operating, the supply side of the jet pump 42 is at a pressure significantly greater than the pressure of the fuel reservoir 14. The pressure at the intake of the jet pump 42 can be, for example, 200 kPa during normal engine operation. This provides a significant backpressure on an outlet 64 of the pressure relief valve 62 when the engine is operating. Because of this backpressure, the set pressure of the pressure relief valve 62 can be substantially less than in the system 10. For example, in a typical arrangement, the set pressure of the pressure relief valve 62 can be 400 kPa when this backpressure of the jet pump 42 is provided.

When the engine 54 is turned off, the backpressure from the jet pump 42 quickly drops to close to atmospheric, so that the pressure relief valve 62 will open when the pressure in the fuel line 30 reaches 400 kPa. This significantly reduces the mechanical load on the fuel supply system 100.

Figure 3:
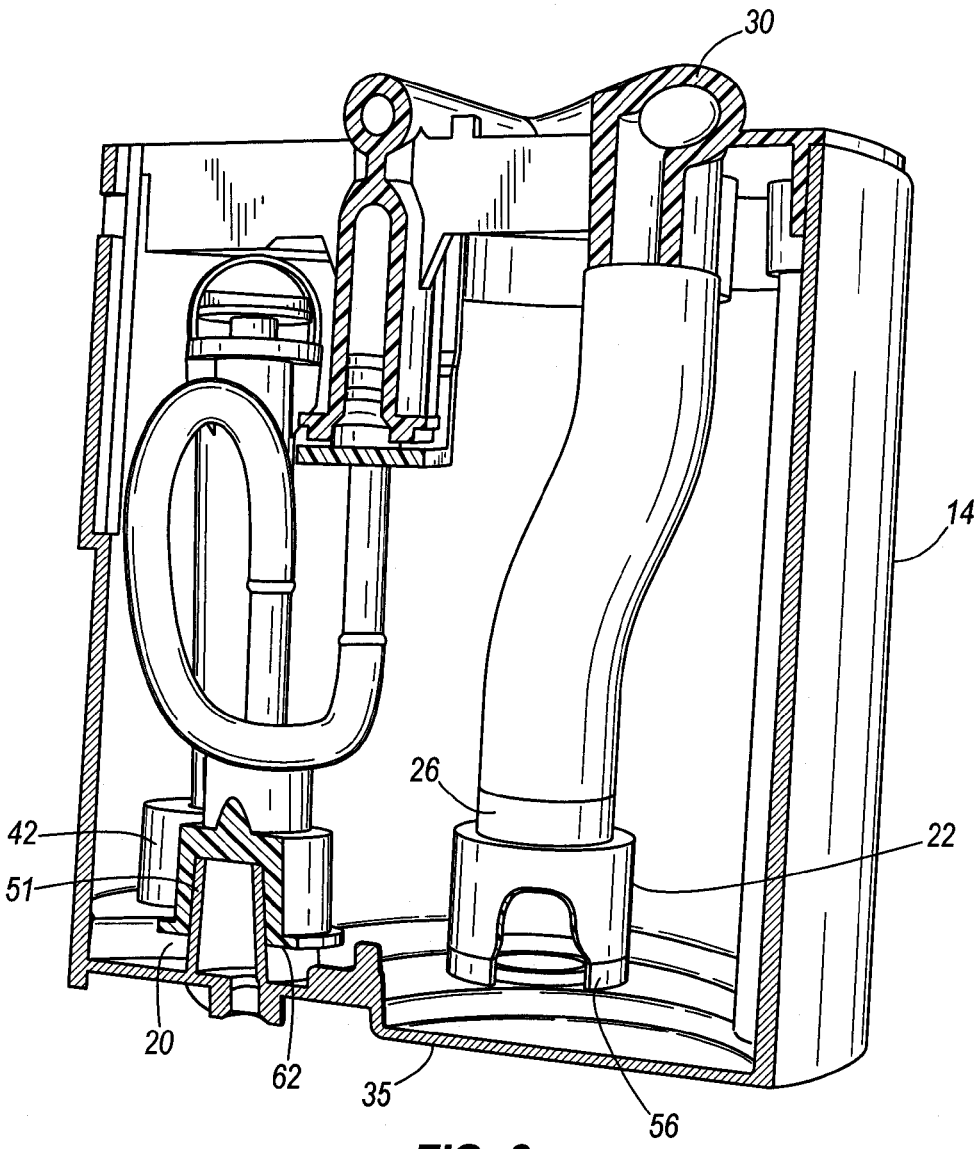
FIG. 3 is a cut-away view of an interior of a reservoir of the fuel supply system of the present invention.

In FIG. 3, an embodiment of a fuel system in accordance with the present invention is shown with a cut-away view of the interior of fuel reservoir 14. The fuel reservoir is in fluid communication with a larger fuel tank (not shown) so as to draw fuel from the larger fuel tank and retain the fuel in the fuel reservoir 14 in a manner that the fuel can be easily and consistently fed to a vehicle engine (not shown). Usually the fuel reservoir is positioned inside the fuel tank. Inside the fuel reservoir 14 is a fuel pump 22 having an outlet in fluid communication via a check valve 26 with the inlet of the fuel line 30. As stated previously in reference to FIGS. 1 and 2, the check valve 26 opens at a relatively low pressure such as 20 kPa.

The outlet of the fuel line 30 communicates with a fuel rail (not shown) that is connected to fuel injectors of an engine (not shown). The fuel supply system 10 can be electronically regulated, and, again, as stated previously, the pump voltage is constantly varied by an electronic control (not shown) in order to maintain a set pressure in the fuel rail.

In the embodiment shown in FIG. 3, the system 10 differs from the system shown in FIG. 2 in that the pressure relief valve 62 is positioned at a lower region of the fuel reservoir 14 and is in relatively direct connection with a jet pump supply channel 20 through a pressure relief valve base 51. The jet pump supply channel 20 provides a fluid flow channel for fluid communication between the jet pump 42, the pressure relief valve 62 and, if desired, the fuel pump 22. The jet pump supply channel 20 is conveniently positioned at the bottom of the fuel reservoir so as to enable fluid communication through a channel structure integrated into a reservoir base structure 35. The reservoir base structure 35 can also provide structural support for the jet pump 42, the pressure relief valve 62, and a base of the fuel pump 22. Therefore, the reservoir base structure 35 provides multiple functions including that of providing a lower boundary or cap for the reservoir 14.

Figure 4:
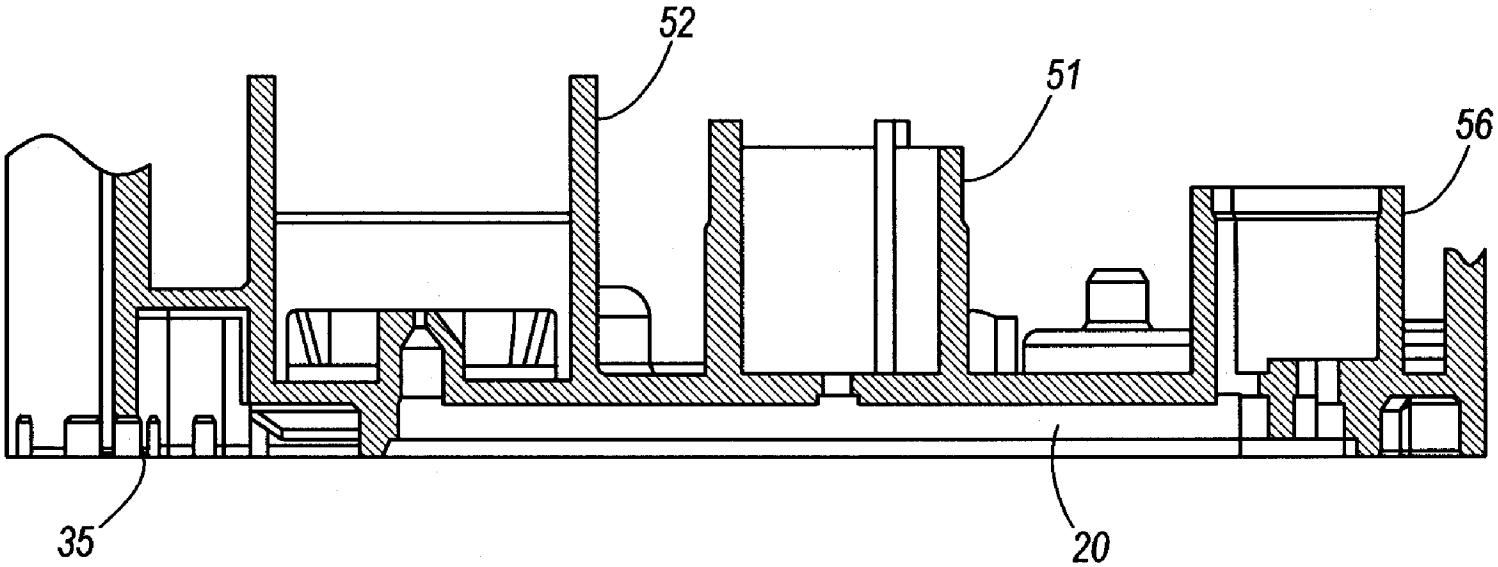
FIG. 4 is a cross-section view of a reservoir base component of FIG. 3.

FIG. 4 is a cross-sectional view of the reservoir base structure 35 from FIG. 3. At a bottom portion of the reservoir base structure 35 the jet pump supply channel 20 is shown with a structure that is integrated or incorporated into the reservoir base structure. To provide the previously described fluid communication, the jet pump supply channel 20 connects a jet pump base 52, a pressure relief valve base 51 and a fuel pump base 56. In the embodiment shown in FIG. 4, the pressure relief valve can be positioned directly on or in the pressure relief valve base 51 in the same manner as shown in FIG. 3. The reservoir base structure 35 provides a fluid communication between these components and provides a bottom cap to the reservoir housing.

As described previously and as shown in FIG. 3, the outlet 64 or discharge of the pressure relief valve 62 is in fluid communication with the jet pump supply inlet. During normal engine operation, the jet pump supply inlet pressure generally ranges between 150 and 200 kPa. This is a pressure at which the system is designed to operate and is a typical jet pump operating pressure. During engine off operation, the pressure supplied to the outlet or discharge side of the pressure relief valve drops rapidly to little or no addition over atmospheric pressure. Therefore, the fuel system can be designed so that system pressure during engine hot soak conditions is limited to a predetermined set point of the pressure relief valve. In other words, the pressure relief valve will redirect flow of fuel from the fuel line through the pressure relief valve at its set point pressure.

As explained previously in relation to FIGS. 1 and 2, the fluid communication between the pressure relief valve and the jet pump supply pressure through the jet pump supply channel 20 also enables operation of the fuel system with a set point of the pressure relief valve at a pressure that is actually lower than pressure in the fuel line during normal engine operation. This is because backpressure from the jet pump supply side inlet is added to set point pressure during engine operation. This prevents misdirected flow of fuel through the pressure relief valve during engine operation even though its set point is at a pressure level below operational pressure in the fuel line. In contrast, when the engine is turned off and hot soak conditions are present, the low level of the pressure relief valve set point will allow redirection of fuel at lower pressure and an earlier time point during hot soak conditions.

Figure 5:
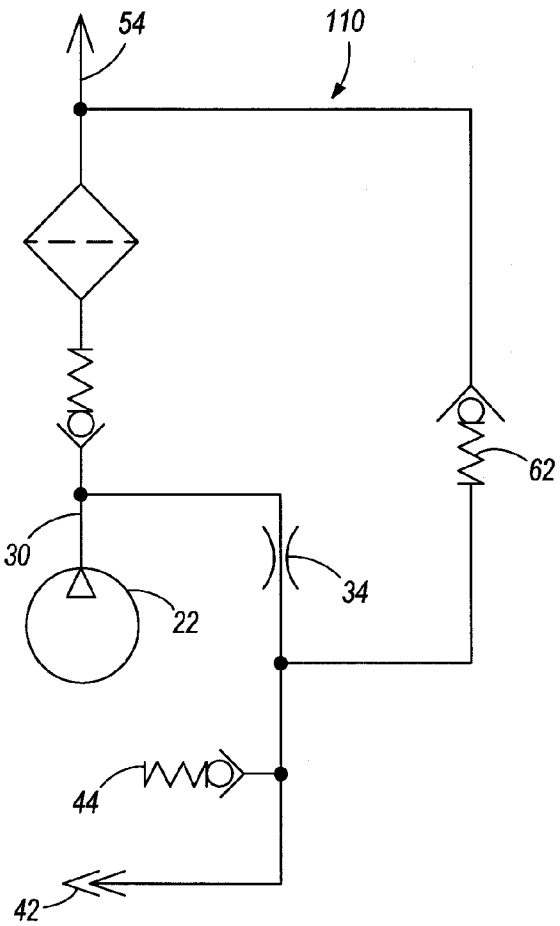
FIG. 5 is a schematic diagram of a fuel supply system having a jet regulator valve.

In FIG. 5 there is shown a fuel supply system 110 of the present invention, in an alternate embodiment. The primary difference between the fuel supply system shown in FIG. 5 and the fuel supply system shown in FIGS. 2, 3 and 4 is the addition of a jet regulator valve 44. The purpose of the jet regulator valve is to control the backpressure on the outlet of the pressure relief valve 62. To provide this function, the jet regulator valve 44 is positioned between the pressure relief valve 62 and the jet pump 42. With the configuration shown in FIG. 5, the jet regulator valve can regulate the backpressure fed to the pressure relief valve in a manner that is desirable for properly influencing the opening and closing of the pressure relief valve 62.

In the embodiment shown, the jet regulator valve 44 is typically set to regulate backpressure to be 200 kPa or 2 bars whenever the fuel pump 22 is on. Using this process, the pressure relief valve 62 can be more accurately utilized and its set point pressure can be more precisely regulated to enhance performance of the fuel system 110. This is because the pressure relief valve 62 is supplied with a relatively consistent quantity of backpressure at the times when the engine is on.

The operation of the fuel system 110 will now be described. The pressure relief valve set point will commonly be set at between 400 and 425 kPa. Correspondingly, the jet pump regulator valve will be set to direct a backpressure of 200 kPa to the outlet 64 of the pressure relief valve 62. The pressure of the fuel supply system in normal operation is typically between approximately 200 and 560 kPa so that system pressure peaks at a maximum value of approximately 560 kPa. Thus, if the pressure relief valve is set to open at 400 kPa and the jet pump regulator valve supplies a backpressure of 200 kPa, the pressure relief valve will actually divert fuel from the fuel line and away from the engine at pressure levels over 600 kPa during engine operation.

When the engine is turned off, the pressure in the jet pump rapidly falls to close to atmospheric pressure. In this condition, the jet regulator valve 44 closes due to a lack of fuel flow. Since the set point of the pressure relief valve is 400 kPa, it will now divert fuel flow from the fuel line at pressure levels over 400 kPa. This is in effect a 200 kPa lower threshold than when the engine is on. It is highly desirable that the pressure relief valve 62 will divert fuel flow at anything over 400 kPa because this will prevent fuel from achieving a pressure greater than 400 kPa during hot soak conditions as described previously.

An advantage of the embodiment of the fuel system 110 in FIG. 5 is it provides a "limp home" capability during a faulty electronic control of the fuel system 110. "Limp home" capability is a function that permits the fuel system to operate at a level that is not optimum but is capable of sufficient operation to drive safely under non-optimum conditions. Commonly, under faulty electronic situations, pressure in the fuel line to the engine can exceed 600 kPa. At high pressures exceeding 600 kPa, the pressure relief valve 62 will open but will not divert enough of the fuel through the pressure relief valve. This can be a problem because excessive pressure in the fuel system may cause fuel leakage.

The addition of the jet pump regulator valve 44 allows the fuel supply system to provide a new flow path for fuel at very high rates when the fuel supply system pressure exceeds desirable levels. The jet regulator valve 44 has an internal structure that moves from fully closed to fully open over a relatively small pressure change. Also, the jet regulator valve structure can divert high volumes of fuel. These characteristics are desirable in situations where faulty electronics cause fluctuations in pressure, sometimes to high levels. The jet pump regulator valve 44 effectively limits pressure in the fuel supply system to approximately 600 kPa as a maximum value.

Figure 6:
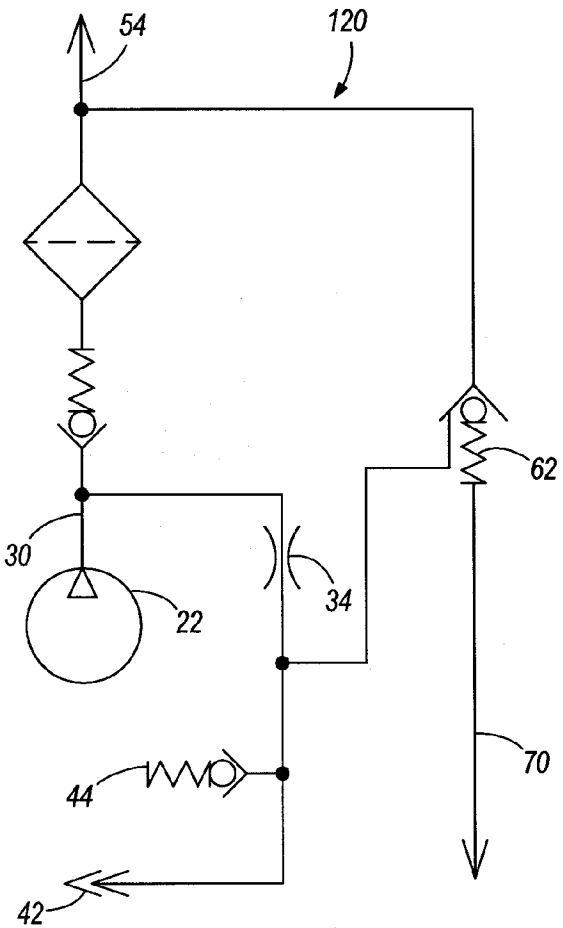
FIG. 6 is a schematic diagram of an alternate embodiment fuel supply system having a jet regulator valve and a direct fuel outlet from the pressure relief valve.

In FIG. 6, a fuel supply system 120 is shown that is the same as the fuel supply system 110 in FIG. 5, but with an addition of a discharge outlet 70 from the pressure relief valve 62 into the fuel reservoir or the fuel tank. This is an alternate embodiment that has a desirable feature of an alternate flow path of fuel through the pressure relief valve 62 in a manner that does not have a significant effect on the operation of the fuel system.

It is to be appreciated that the present invention as shown in any of the embodiments can be practiced or utilized with a variety of different types of fuel systems and fuel pumps. For example, both gasoline engine and diesel engine fuel systems and fuel pumps are practical for use with the present invention. Additionally, fuel pumps with an impeller (turbine) or positive displacement type pump are useable with the present invention. Various other types of fuel pumps might be utilized successfully with the present invention. Fuel systems with mechanical or electrical pressure regulation can employ the present invention.

It is also to be appreciated that different types of motors for powering the fuel pump might be utilized. Motors such as both commutation-type electric motors and brushless electric motors are applicable. Again, it is appreciated that there are other types of motors or power sources for the fuel pump that could be utilized while practicing the present invention.

Thus, the invention provides, among other things, a fuel supply system for an engine in which the outlet of a pressure relief valve in the fuel line is provided with backpressure when the engine is operating. This allows fuel system operation with the pressure relief valve set to open at a lower pressure level to help prevent undesirable levels of fuel from entering the engine when it is turned off. Various features and advantages of the invention are set forth in the following claims.

What is claimed is:

1. A fuel supply system for delivering fuel from a tank to an engine of a motor vehicle, comprising:

a reservoir for receiving fuel from the tank;

a jet pump having a supply side inlet receiving fuel during engine operation to power the jet pump, and a jet pump outlet for supplying fuel from the tank to the reservoir;

a fuel supply pump for supplying fuel from the reservoir to the engine though a fuel line;

a pressure relief valve having an inlet in fluid communication with the fuel line at a location between the fuel supply pump and the engine; and the pressure relief valve having an outlet in fluid communication with the pressurized supply side inlet of the jet pump to provide backpressure on the pressure relief valve outlet during engine operation, the backpressure biasing the pressure relief valve closed;

wherein the pressure relief valve is closed during normal engine operation such that no fuel in the fuel line flows though the pressure relief valve to the jet pump supply side inlet to power the jet pump.

2. The fuel supply system of claim 1 wherein fluid communication of backpressure to the pressure relief valve outlet enables operation of the fuel supply system with a set pressure of the pressure relief valve at a level below operational pressure in the fuel line during normal engine operation.

3. The fuel supply system of claim 1 wherein the fuel pump is provided with an outlet in fluid communication with the pressurized jet pump supply side inlet.

4. The fuel supply system of claim 3 wherein the fuel pump outlet is provided with a throttled orifice and a check valve.

5. The fuel supply system of claim 4 wherein the fuel pump is provided with a fuel inlet from within the reservoir.

6. The fuel supply system of claim 2 wherein the fuel pump is provided with an outlet in fluid communication with the pressurized jet pump supply side inlet.

7. The fuel supply system of claim 6 wherein the fuel pump outlet is provided with a throttled orifice and a check valve.

8. A fuel supply system for delivering fuel from a tank to an engine of a motor vehicle, comprising:

a reservoir for receiving fuel from the tank;

a jet pump having a supply side inlet receiving fuel during engine operation to power the jet pump, and a jet pump outlet for supplying fuel to the reservoir;

a fuel supply pump having an outlet for supplying fuel from the reservoir to the engine through a fuel line;

a pressure relief valve in fluid communication with the fuel line at a location between the fuel supply pump and the engine; and the pressure relief valve being provided with fluid communication between the pressurized supply side inlet of the jet pump and an outlet of the pressure relief valve to provide backpressure on the pressure relief valve outlet during engine operation, the backpressure biasing the pressure relief valve closed, enabling operation of the fuel supply system with a set point of the pressure relief valve at a level below fuel line pressure during normal engine operation;

wherein the pressure relief valve is closed during normal engine operation such that no fuel in the fuel line flows through the pressure relief valve to the jet pump supply side inlet to power the jet pump.

9. A fuel supply system for delivering fuel from a tank to an engine of a motor vehicle, comprising:

a reservoir for receiving fuel from the tank;

a fuel supply pump for supplying fuel from the reservoir to the engine though a fuel line; and a pressure relief valve having an inlet in fluid communication with the fuel line at a location between the fuel supply pump and the engine, the pressure relief valve being closed during normal engine operation such that no fuel in the fuel line flows though the pressure relief valve, and having a pressure relief valve outlet that is provided with a source of backpressure during engine operation, the backpressure biasing the pressure relief valve closed so as to enable operation of the fuel supply system with a set point of the pressure relief valve at a level below fuel line pressure during normal engine operation.

10. The fuel supply system of claim 9 wherein the pressure relief valve outlet is provided with a supply of backpressure in a range between 100 kPa and 300 kPa.

11. The fuel supply system of claim 1 wherein the reservoir is provided with a reservoir base structure having a jet pump supply channel providing fluid communication between the pressurized jet pump supply side inlet and the pressure relief valve outlet.

12. The fuel supply system of claim 11 wherein the jet pump supply channel is in fluid communication with a jet regulator valve for the purpose of regulating backpressure on the pressure relief valve outlet.

13. The fuel supply system of claim 12 wherein the jet regulator valve is set to open at a pressure level in a range between 150 and 250 kPa.

14. The fuel supply system of claim 12 wherein the pressure relief valve is provided with a second outlet for discharging fuel into the reservoir or the tank.

15. The fuel supply system of claim 12 wherein the fuel line is provided with a line for fluid communication with the jet pump supply channel from a location on the fuel line that is upstream of the inlet to the pressure relief valve.

16. The fuel supply system of claim 15 wherein the line for fluid communication between the fuel line and the jet pump supply channel is provided with a throttle.

17. The fuel supply system of claim 2 wherein the reservoir is provided with a reservoir base structure incorporating a jet pump supply channel providing fluid communication between the pressurized jet pump supply side inlet and the pressure relief valve outlet.

18. The fuel supply system of claim 17 wherein the jet pump supply channel is in fluid communication with a jet regulator valve for the purpose of regulating backpressure supplied to the pressure relief valve outlet.

19. The fuel supply system of claim 1 having a jet regulator valve to regulate backpressure supplied to the pressure relief valve outlet.

20. The fuel supply system of claim 2 having a jet regulator valve to regulate backpressure supplied to the pressure relief valve outlet.

21. A fuel supply system for delivering fuel from a tank to an engine of a motor vehicle, comprising:

a reservoir for receiving fuel from the tank;

a jet pump having a supply side inlet receiving fuel during engine operation to power the jet pump, and jet pump outlet for supplying fuel from the tank to the reservoir;

a fuel supply pump for supplying fuel through a first outlet to a fuel line to the engine;

a pressure relief valve in fluid communication with the fuel line at a location between the fuel supply pump and the engine;

the pressure relief valve being provided with fluid communication between the pressurized supply side inlet of the jet pump and an outlet of the pressure relief valve for the purpose of providing backpressure on the pressure relief valve outlet during engine operation, the backpressure biasing the pressure relief valve closed to enable operation of the fuel supply system with a set point of the pressure relief valve at a level below operational pressure in the fuel line during normal engine operation;

wherein the pressure relief valve is closed during normal engine operation such that no fuel in the fuel line flows through the pressure relief valve to the jet pump supply side inlet to power the jet pump;

the reservoir having a base structure incorporating a jet pump supply channel that provides fluid communication between a pressure relief valve base, a jet pump base, and a fuel pump base, thereby providing fluid communication between the jet pump supply side inlet, the pressure relief valve outlet and the fuel pump; and a jet regulator valve provided in fluid communication with the jet pump supply channel for the purpose of regulating backpressure provided to the outlet of the pressure relief valve.

22. The fuel supply system of claim 21 wherein the jet regulator valve controls backpressure with a constant level of backpressure provided to the pressure relief valve during engine operation and less backpressure is provided to the pressure relief valve when the engine is turned off.

23. A fuel supply system for delivering fuel from a tank to an engine of a motor vehicle, comprising:

a fuel supply pump for supplying fuel from the tank to the engine through a fuel line;

a pressure relief valve in fluid communication with the fuel line and operable to open for relieving pressure in the fuel line when the pressure exceeds a certain value during normal engine operation, the pressure relief valve being closed during normal engine operation such that no fuel in the fuel line flows through the pressure relief valve, the pressure relief valve having a set point pressure; and a pressure source in fluid communication with the pressure relief valve, the pressure source providing backpressure to the pressure relief valve, the backpressure biasing the pressure relief valve closed and being greater during engine operation than when the engine is not operating, so that the certain value is the sum of the backpressure and the set pressure during normal engine operation, and so that the pressure relief valve opens and provides pressure relief at a pressure below the certain value when the engine is not operating.

24. The fuel supply system of claim 23 wherein the backpressure provided by the pressure source is minimal when the engine is not operating, so that the pressure relief valve provides pressure relief at the set point pressure when the engine is not operating.

* * * * *